US008805687B2

(12) United States Patent
Conkie et al.

(10) Patent No.: US 8,805,687 B2
(45) Date of Patent: Aug. 12, 2014

(54) SYSTEM AND METHOD FOR GENERALIZED PRESELECTION FOR UNIT SELECTION SYNTHESIS

(75) Inventors: Alistair D. Conkie, Morristown, NJ (US); Mark Beutnagel, Mendham, NJ (US); Yeon-Jun Kim, Whippany, NJ (US); Ann K. Syrdal, Morristown, NJ (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 1090 days.

(21) Appl. No.: 12/563,654

(22) Filed: Sep. 21, 2009

(65) Prior Publication Data

US 2011/0071836 A1 Mar. 24, 2011

(51) Int. Cl.
*G10L 13/06* (2013.01)

(52) U.S. Cl.
CPC ..... *G10L 13/06* (2013.01)
USPC ..... 704/258; 704/260; 704/269

(58) Field of Classification Search
CPC ..... G10L 13/06
USPC ..... 704/258, 260
See application file for complete search history.

(56) References Cited

U.S. PATENT DOCUMENTS

| | | | | |
|---|---|---|---|---|
| 6,173,263 | B1 * | 1/2001 | Conkie | 704/260 |
| 6,684,187 | B1 * | 1/2004 | Conkie | 704/260 |
| 7,418,389 | B2 * | 8/2008 | Chu et al. | 704/267 |
| 2003/0023442 | A1 * | 1/2003 | Akabane et al. | 704/260 |
| 2004/0111266 | A1 * | 6/2004 | Coorman et al. | 704/260 |
| 2005/0182629 | A1 * | 8/2005 | Coorman et al. | 704/266 |
| 2007/0011009 | A1 * | 1/2007 | Nurminen et al. | 704/260 |
| 2008/0077407 | A1 * | 3/2008 | Beutnagel et al. | 704/261 |

OTHER PUBLICATIONS

A. Conkie "Robust Unit Selection System for Speech Synthesis", AT&T Labs—Research, Shannon Labs, 180 Park Ave., Florham Park, NJ 07932 USA—5 pages, 1999.

A. Conkie et al. "Preselection of Candidate Units in A Unit Selection-Based Text-To-Speech Synthesis System", AT&T Labs—Research, Florham Park, NJ, USA—4 pages, *Int. Conf. Spoken Language Processing*, Beijing, China, 2000.

A.W. Black et al. "Automatically Clustering Similar Units for Unit Selection in Speech Synthesis", Centre for Speech Technology Research, University of Edinburgh, 80, South Bridge, Edinburgh, U.K. EH1 1HN—4 pages, EuroSpeech, 1997.

A.J. Hunt et al. "Unit Selection in A Concatenative Speech Synthesis System Using A Large Speech Database", ATR Interpreting Telecommunications Research Labs, 2-2 Hikaridai, Seika-cho, Soraku0gun, Kyoto 619-02, Japan. To appear in Proc. ICASSP-96, May 7-10, Atlanta, GA, © IEEE 1996—4 pages.

* cited by examiner

*Primary Examiner* — Jialong He

(57) ABSTRACT

Disclosed herein are systems, computer-implemented methods, and computer-readable storage media for unit selection synthesis. The method causes a computing device to add a supplemental phoneset to a speech synthesizer front end having an existing phoneset, modify a unit preselection process based on the supplemental phoneset, preselect units from the supplemental phoneset and the existing phoneset based on the modified unit preselection process, and generate speech based on the preselected units. The supplemental phoneset can be a variation of the existing phoneset, can include a word boundary feature, can include a cluster feature where initial consonant clusters and some word boundaries are marked with diacritics, can include a function word feature which marks units as originating from a function word or a content word, and/or can include a pre-vocalic or post-vocalic feature. The speech synthesizer front end can incorporates the supplemental phoneset as an extra feature.

17 Claims, 3 Drawing Sheets

SYSTEM AND METHOD FOR GENERALIZED PRESELECTION FOR UNIT SELECTION SYNTHESIS

BACKGROUND

1. Technical Field

The present disclosure relates to speech synthesis and more specifically to preselecting units in unit selection synthesis.

2. Introduction

Many speech synthesis approaches exist, such as concatenative synthesis, formant synthesis, and synthesis based on hidden Markov models. Unit selection synthesis is a sub-type of concatenative synthesis. Unit selection synthesis generally uses a large database of speech. A unit selection algorithm selects units from a database that correspond to the desired units and obey the constraint that adjacent units form a good match. Expressed in mathematical terms, a network of candidate units is constructed and target costs are given to each unit in the network on the basis of some appropriateness measure. A concatenation or join cost represents the quality of concatenation of two speech segments. After constructing the network and assigning costs, the network is examined to determine the lowest cost path through the network. The algorithm then selects and concatenates together units that form the lowest cost path to produce the synthetic speech for the requested text or symbolic input.

A preselection phase cursorily examines candidate units for a synthetic utterance and only uses the most promising in the network calculation phase. This approach can dramatically improve the performance of the system. So long as the preselection is done wisely, preselection does not greatly impact the overall quality of the system. A typical limitation might be to 50 candidates. The speed of such a system is represented in Big O notation as $O(n^2)$, where n is the number of candidates.

To be effective, unit preselection should be computationally cheap and performed on the basis of context. The fitness of a unit is determined by comparing the original context of the unit in the voice database to the proposed position of the unit in the context to be synthesized. In an example where a speech synthesizer preselects a vowel V that will occur in a t-V-r context, the synthesizer will favor examples of that vowel that also occur in t-V-r contexts as being more likely to result in high quality synthesis. This system works, but does not perform at an optimal level with regards to accuracy and efficiency.

Existing approaches are approximate and inflexible, tied to the phoneset used for recognition. They compare broad classes, phonemes rather than allophones. Because of this preselected candidate units may be only somewhat appropriate while some very appropriate units fail to make the cut and are not considered further.

Existing approaches are inefficient. System architectures cause a notable bias towards units that occur towards one end of the database, such that some units in the database are underutilized. Effectively such systems are working with a reduced size database.

Previous work has introduced the concept of a pre- and post- vocalic distinction for some of the units in the database. While this has produced candidate lists that consist of generally more appropriate units, one negative effect is a need to replace existing standard phonesets with new specially designed phonesets as part of the solution, hindering synthesizer interoperability. Older work also added code to deal on an ad hoc basis with some other limitations of the preselection system concerned with word boundaries.

SUMMARY

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed are systems, methods, and computer-readable storage media for unit selection synthesis. The method causes a computing device to add a supplemental phoneset to a speech synthesizer front end having an existing phoneset, modify a unit preselection process based on the supplemental phoneset, preselect units using the supplemental phoneset and the existing phoneset based on the modified unit preselection process, and generate speech based on the preselected units. The supplemental phoneset can be a variation of the existing phoneset, can include a word boundary feature, can include a cluster feature where initial consonant clusters and some word boundaries are marked with diacritics, can include a function word feature which marks units as originating from a function word or a content word, and/or can include a pre-vocalic or post-vocalic feature. The speech synthesizer front end can incorporate the supplemental phoneset as an extra feature.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Figure 1:
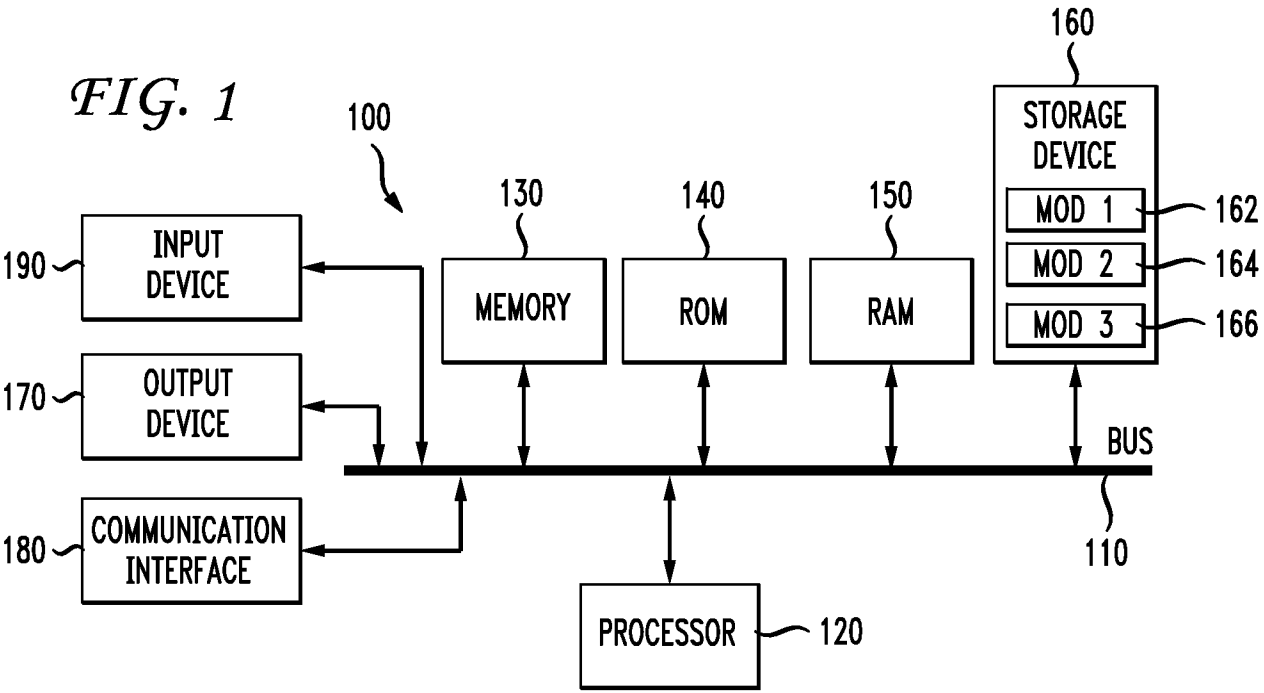
FIG. 1 illustrates an example system embodiment.

With reference to FIG. 1, an exemplary system 100 includes a general-purpose computing device 100, including a processing unit (CPU or processor) 120 and a system bus 110 that couples various system components including the system memory 130 such as read only memory (ROM) 140 and random access memory (RAM) 150 to the processor 120. These and other modules can be configured to control the processor 120 to perform various actions. Other system memory 130 may be available for use as well. It can be appreciated that the disclosure may operate on a computing device 100 with more than one processor 120 or on a group or cluster of computing devices networked together to provide greater processing capability. The processor 120 can include any general purpose processor and a hardware module or software module, such as module 1 162, module 2 164, and module 3 166 stored in storage device 160, configured to control the processor 120 as well as a special-purpose processor where software instructions are incorporated into the actual processor design. The processor 120 may essentially be a completely self-contained computing system, containing multiple cores or processors, a bus, memory controller, cache, etc. A multi-core processor may be symmetric or asymmetric.

The system bus 110 may be any of several types of bus structures including a memory bus or memory controller, a peripheral bus, and a local bus using any of a variety of bus architectures. A basic input/output (BIOS) stored in ROM 140 or the like, may provide the basic routine that helps to transfer information between elements within the computing device 100, such as during start-up. The computing device 100 further includes storage devices 160 such as a hard disk drive, a magnetic disk drive, an optical disk drive, tape drive or the like. The storage device 160 can include software modules 162, 164, 166 for controlling the processor 120. Other hardware or software modules are contemplated. The storage device 160 is connected to the system bus 110 by a drive interface. The drives and the associated computer readable storage media provide nonvolatile storage of computer readable instructions, data structures, program modules and other data for the computing device 100. In one aspect, a hardware module that performs a particular function includes the software component stored in a tangible and/or intangible computer-readable medium in connection with the necessary hardware components, such as the processor 120, bus 110, display 170, and so forth, to carry out the function. The basic components are known to those of skill in the art and appropriate variations are contemplated depending on the type of device, such as whether the device 100 is a small, handheld computing device, a desktop computer, or a computer server.

Although the exemplary embodiment described herein employs the hard disk 160, it should be appreciated by those skilled in the art that other types of computer readable media which can store data that are accessible by a computer, such as magnetic cassettes, flash memory cards, digital versatile disks, cartridges, random access memories (RAMs) 150, read only memory (ROM) 140, a cable or wireless signal containing a bit stream and the like, may also be used in the exemplary operating environment. Tangible computer-readable storage media expressly exclude media such as energy, carrier signals, electromagnetic waves, and signals per se.

To enable user interaction with the computing device 100, an input device 190 represents any number of input mechanisms, such as a microphone for speech, a touch-sensitive screen for gesture or graphical input, keyboard, mouse, motion input, speech and so forth. The input device 190 may be used by the presenter to indicate the beginning of a speech search query. An output device 170 can also be one or more of a number of output mechanisms known to those of skill in the art. In some instances, multimodal systems enable a user to provide multiple types of input to communicate with the computing device 100. The communications interface 180 generally governs and manages the user input and system output. There is no restriction on operating on any particular hardware arrangement and therefore the basic features here may easily be substituted for improved hardware or firmware arrangements as they are developed.

For clarity of explanation, the illustrative system embodiment is presented as including individual functional blocks including functional blocks labeled as a "processor" or processor 120. The functions these blocks represent may be provided through the use of either shared or dedicated hardware, including, but not limited to, hardware capable of executing software and hardware, such as a processor 120, that is purpose-built to operate as an equivalent to software executing on a general purpose processor. For example the functions of one or more processors presented in FIG. 1 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 140 for storing software performing the operations discussed below, and random access memory (RAM) 150 for storing results. Very large scale integration (VLSI) hardware embodiments, as well as custom VLSI circuitry in combination with a general purpose DSP circuit, may also be provided.

The logical operations of the various embodiments are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. The system 100 shown in FIG. 1 can practice all or part of the recited methods, can be a part of the recited systems, and/or can operate according to instructions in the recited tangible computer-readable storage media. Generally speaking, such logical operations can be implemented as modules configured to control the processor 120 to perform particular functions according to the programming of the module. For example, FIG. 1 illustrates three modules Mod1 162, Mod2 164 and Mod3 166 which are modules configured to control the processor 120. These modules may be stored on the storage device 160 and loaded into RAM 150 or memory 130 at runtime or may be stored as would be known in the art in other computer-readable memory locations.

The approach disclosed herein for formulating preselection involving multiple phonesets is more general than previous methods and leads to enhanced unit selection synthesis. Unit selection synthesis is based, in part, on target costs which are intended as a measure of the suitability of a particular unit for use in synthesis. A speech synthesizer converts input text in the front end to an acoustic and symbolic specification in terms of phone identity, duration and f0, and optionally including other potential feature quantities such as energy or allophone type.

Typically a unit selection based speech synthesizer undergoes a weight training process based on acoustics whereby an attempt is made to relate these specification features to perceptual differences. Using the trained weights and the features considered relevant to unit selection, a system performing the disclosed speech synthesis method can estimate the target cost for any database unit for any synthesis context/specification. In some embodiments, rather than using perceptual differences, the system substitutes cepstral distance measures as an approximation.

Figure 2:
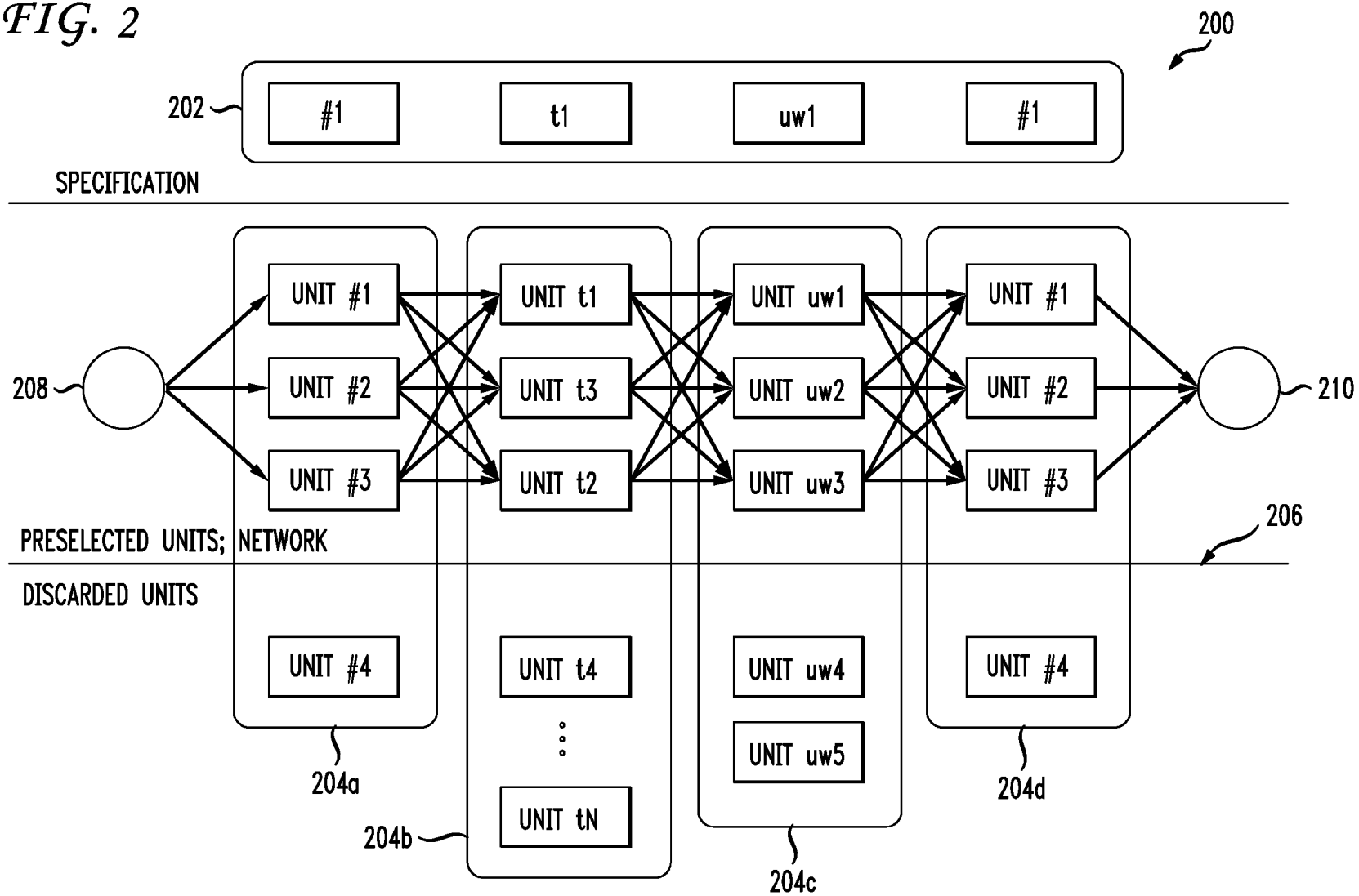
FIG. 2 illustrates a preselection and search process.

FIG. 2 illustrates various aspects of the preselection and search process 200. Once the system knows a specification 202, the system retrieves lists of matching units 204*a-d* in the database without regard to context. The system calculates the preselection cost for each unit. The system retains the lowest cost n units, and no longer considers the remaining units. In this example, the system retains the three lowest cost n units, however the system can also retain all units above a cost threshold 206 regardless of how many actual units remain and no longer consider units below the cost threshold 206. The system can determine the cost threshold based on desired performance and/or synthesis quality characteristics or based on user input. The system performs full target and join cost calculations only for the preselected units, and finally calculates the lowest cost path through the preselected units from the beginning 208 to the end 210. For example, the lowest cost path from beginning 208 to end 210 could be unit #2, unit t1, unit uw1, and unit #3.

The preselection step reduces the number of candidate units for unit selection. The number of join costs to be calculated for each unit has a Big-O of $N^2$, where N is the maximum number of candidate units considered in the Viterbi network, so preselection is an important step to achieve acceptable performance. The preselection step for a particular unit has a Big-O of N log N, where N is the number of phones of that type in the database. Determining join costs can be one of the most expensive parts of the calculation.

The approach and principles disclosed herein provide several benefits in the preselection portion of unit selection synthesis. One important benefit is better preselection which leads to higher quality synthesis. The solution described herein for enhancing preselection is non-disruptive and extensible. A speech synthesizer need not rely on a single phoneset and an arbitrary set of conventions, which may change as the system is enhanced, leading to compatibility problems with older systems. A system using multiple phonesets has flexibility in the construction of the unit selection in general. Any unit selection component is free to use as many or as few of the phonesets as appropriate. The solution herein is language independent. The solution preselects units more effectively, to make better use of the entire database. Existing phonesets can remain a part of a speech synthesizer, but can be supplemented with more detailed information in order to make finer distinctions in the preselection. A speech synthesizer is not forced to recalculate its existing phoneme comparison matrix each time new phonemes are added. Such an approach is more flexible because boundaries are not categorical but can be controlled by weights.

A system practicing the method set forth herein can add additional phoneme information to the front end module of the synthesizer. 4 exemplary types of additional phoneme information are set forth, but the system is extensible and can incorporate more or less than 4. The system adds additional phoneme information to a voice database in the form of variants of the phoneset. The exemplary new features include (1) a word boundary feature which describes whether a given unit is immediately before or after a word boundary, (2) a "CSTR" feature which marks initial consonant clusters and some word boundaries with diacritics, (3) a function word feature which marks phonemes/units as coming from either a function word or a content word, and (4) a pre-/post-vocalic feature as described in U.S. patent application Ser. No. 11/535,146, which is incorporated herein by reference.

The first exemplary new feature is the word boundary feature. The system adds a feature where word boundary positions are associated with phonemes. For example, "the cat" is represented as "|dh ax| |k ae t|" rather than "dh ax k ae t", and "|ay|" represents the word "I" rather than "ay".

The second exemplary new feature is the initial constant clusters and diacritics for glottals and flaps. For this feature the system can use an aspect of the Festival speech synthesis system in two parts. For the first part the system distinguishes between initial consonant clusters and other consonant clusters. Some examples include representing "string" as "s__ __t__ __r ih ng", but "last" as "l ae s t" and "prime" as "p__ __r ay m". Additionally, at word boundaries where a vowel is adjacent to a stop a $ is added to the stop. For example, "eat it" would be "iy t$ ih t". The underlying assumption is that these diacritics, based on initial consonant clusters being distinct and the possible occurrence of glottal stop or flap allophones of t as in example "iy dx ih t" are in a unit selection context. The diacritics can be combined so that, for example, $t_ is a possible "decorated" phoneme feature. This can occur where the t is part of a word-initial consonant cluster that follows a word ending with a vowel.

The third exemplary new feature distinguishes and marks units as coming from a function word or a content word. This approach can avoid phonemes from function words being used in content words, particularly in stressed positions. This distinction can be advantageous. If the system considers a word to be a function word, the system labels the phonemes with an additional _f in the "func" feature. So "m_f" would be the function word version of "m" and "the" would become "dh_f ax_f".

The fourth exemplary new feature is a pre- and post-vocalic feature. The system converts the enhanced phones described in Ser. No. 11/535,146 into a feature and uses ARPAbet phonemes for the basic unit phone categories. This enhanced phone set distinguishes pre- and post-vocalic consonants. The syllabification scheme adopted influences where the feature is applied and should be consistent for best results. As an example of usage, "last" would be transcribed "l ae s- t-", whereas "star" would be transcribed "s t aa r-".

The system modifies the preselection process so that feature comparisons are possible based on the new phone features, and not exclusively on the standard phone set. The preselection cost has a component for context (and an implicit component for phoneme identity). To this the system adds costs associated with the various specialized sub-types for the phoneme, as defined by the four new features or by other new features. The system can adopted a simple difference penalty approach for the new features. When a requested feature is in disagreement with the corresponding database feature, the cost is higher.

Each of these four features forms a distinct phoneset. Together with the original phoneset the system draws from a total of 5 variant phonesets to be used as appropriate. The database incorporates these extra features as it would an extra feature such as delta f0.

One advantage of specifying features separately in terms of phonesets is that the system can ignore features it does not know about because of how the system is designed. For example, an older system which only operates in terms of plain phonemes can safely ignore the additional sets of features in a newer voice and use the newer voice as is. Conversely a newer system with an older voice will be able to carry out the old preselection adjustments without modification. While this may not give the highest quality synthesis, this approach ensures that the system works effectively.

As set forth above, the system modifies the preselection mechanism. This modification works on the basis of contexts. Broadly speaking, a context of plus or minus 2 phonemes is the range of effectiveness in determining modifications to the form of a phoneme. The system compares where the desired sequence of units and the database sequences of units are. The system weights the nearest phonemes most heavily and the more distant phonemes less heavily. The system weights intermediate phonemes progressively more or less heavily depending on their position in either discrete weight steps or in a smoothly graduated fashion. This is not changed as the system introduces new features, as is required with the original pre-/post-vocalic formalism. The system adds a new component to the cost calculation. The system performs the original cost calculation in terms of the broad phoneme classes, then adds extra costs to the calculation based on whether the unit of interest agrees in terms of the other phonesets, assuming the new features exist in the voice database. The extra calculations are purely local and not based on context, meaning that they are not restricted to the phoneme or unit in question. By having the extra cost calculation the system effectively makes finer distinctions at the preselection stage, and is able to preselect units which are more relevant for consideration and potential use during synthesis.

Figure 3:
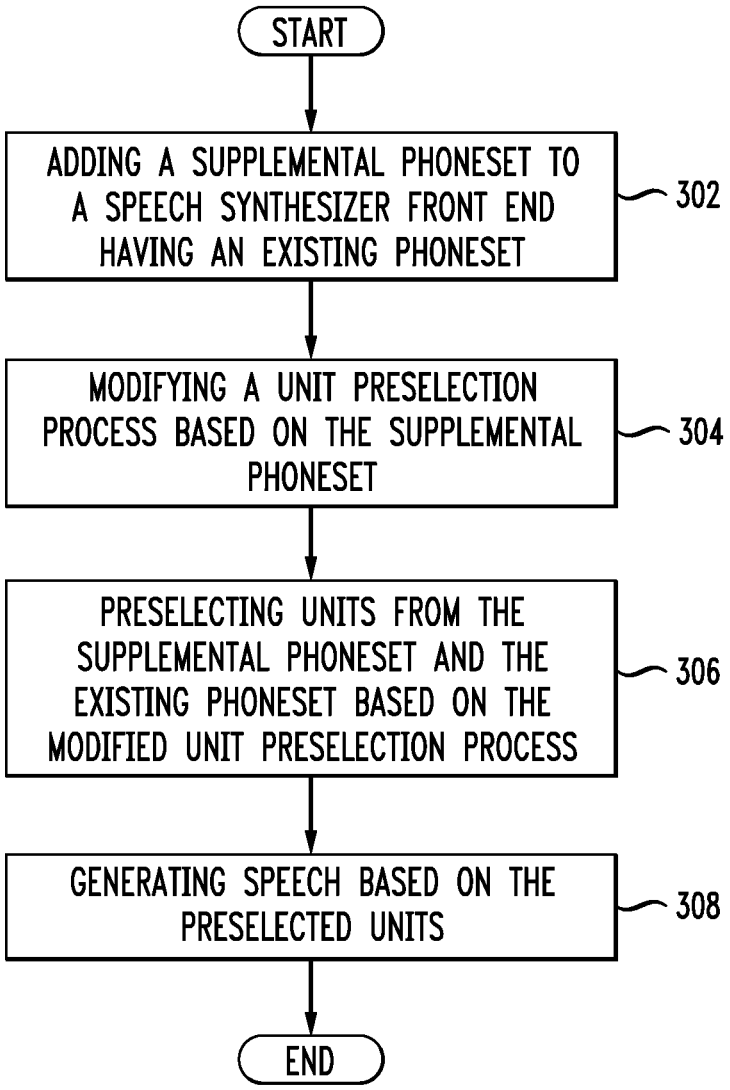
FIG. 3 illustrates an example method embodiment.

Having disclosed some basic system components and concepts, the disclosure now turns to the exemplary method embodiment shown in FIG. 3. For the sake of clarity, the method is discussed in terms of an exemplary system such as is shown in FIG. 1 configured to practice the method.

FIG. 3 illustrates an example method embodiment for generalized preselection in unit selection synthesis. The method causes a computing device such as the system of FIG. 1 to perform the following steps. First, the system adds a supplemental phoneset to a speech synthesizer front end having an existing phoneset (202). Second, the system modifies a unit preselection process based on the supplemental phoneset (204). As set forth above, the supplemental phoneset can be a variation of the existing phoneset such as a word boundary feature, a cluster feature where initial consonant clusters and some word boundaries are marked with diacritics, a function word feature which marks units as originating from a function word or a content word, and a pre-vocalic and/or post-vocalic feature. The speech synthesizer front end can incorporate the supplemental phonesets as extra features.

The system preselects units from the supplemental phoneset and the existing phoneset based on the modified unit preselection process (206). Preselecting units can include assigning costs to units in one phoneset based on whether a unit of interest agrees in terms of another phoneset. The system generates speech based on the preselected units (208).

The solution described herein is language independent, whereas a pre-/post-vocalic feature-based approach as described in U.S. patent application Ser. No. 11/535,146 is not. The solution preselects units more effectively, and makes better, more complete use of the database. The system can retain an old phoneset and supplement the information in the phoneset with more detailed information as it becomes available (through automatic learning, manual data entry, and/or other sources) in order to make finer, more accurate distinctions in the preselection process. The system has no need to recalculate its existing phoneme comparison matrix each time new phonemes are added. Further, this approach is more flexible. For example, boundaries are not categorical as in U.S. patent application Ser. No. 11/535,146, but the system can control boundaries by weights.

Embodiments within the scope of the present disclosure may also include tangible computer-readable storage media for carrying or having computer-executable instructions or data structures stored thereon. Such computer-readable storage media can be any available media that can be accessed by a general purpose or special purpose computer, including the functional design of any special purpose processor as discussed above. By way of example, and not limitation, such computer-readable media can include RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Those of skill in the art will appreciate that other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

The various embodiments described above are provided by way of illustration only and should not be construed to limit the scope of the disclosure. For example, the principles herein can be applied to nearly any speech synthesis application such as an automated dialog system. Those skilled in the art will readily recognize various modifications and changes that may be made to the principles described herein without following the example embodiments and applications illustrated and described herein, and without departing from the spirit and scope of the disclosure.

We claim:

1. A method comprising:

adding a supplemental phoneset to a speech synthesizer front end having an existing phoneset, wherein the supplemental phoneset comprises a cluster feature where initial consonant clusters and a word boundary are marked with diactitics;

modifying a unit preselection process by adding costs associated with the supplemental phoneset to a preselection cost that is part of the unit preselection process, to yield a modified unit preselection process;

preselecting units from the supplemental phoneset and the existing phoneset based on the modified unit preselection process, to yield preselected units; and generating speech based on the preselected units.

2. The method of claim 1, wherein the supplemental phoneset is a variation of the existing phoneset.

3. The method of claim 1, wherein the supplemental phoneset comprises a word boundary feature.

4. The method of claim 1, wherein the supplemental phoneset comprises a function word feature which marks units as originating from one of a function word and a content word.

5. The method of claim 1, wherein the supplemental phoneset comprises one of a pre-vocalic and a post-vocalic feature.

6. The method of claim 1, wherein the speech synthesizer front end incorporates the supplemental phoneset as an extra feature.

7. The method of claim 6, wherein preselecting of the units further comprises assigning costs to units in one phoneset based on whether a unit of interest agrees in terms of another phoneset.

8. A system comprising:

a processor;

a computer-readable storage medium having instructions stored which, when executed by the processor, cause the processor to perform operations comprising:

adding a supplemental phoneset to a speech synthesizer front end having an existing phoneset, wherein the suppliemental phoneset comprises a cluster feature where initial consonant clusters and a work boundary are marked with diacritics;

modifying a unit preselection process by adding costs associated with the supplemental phoneset to a preselection cost that is part of the unit preselection process, to yield a modified unit preselection process;

preselecting units from the supplemental phoneset and the existing phoneset based on the modified unit preselection process, to yield preselected units; and generating speech based on the preselected units.

9. The system of claim 8, wherein the supplemental phoneset is a variation of the existing phoneset.

10. The system of claim 8, wherein the supplemental phoneset comprises a word boundary feature.

11. The system of claim 8, wherein the supplemental phoneset comprises a function word feature which marks units as originating from one of a function word and a content word.

12. The system of claim 8, wherein the supplemental phoneset comprises a pre-vocalic and a post-vocalic feature.

13. The system of claim 8, wherein the speech synthesizer front end incorporates the supplemental phoneset as an extra feature.

14. The system of claim 13, wherein preselection of the units further comprises assigning costs to units in one phoneset based on whether a unit of interest agrees in terms of another phoneset.

15. A computer-readable storage device having instructions stored which, when executed by a computing device, cause the computing device to perform a method comprising:

adding a supplemental phoneset to a speech synthesizer front end having an existing phoneset, wherein the supplemental phoneset comprises a cluster feature where initial consonant clusters and a word boundary are marked with diacritics;

modifying a unit preselection process by adding costs associated with the supplemental phoneset to a preselection cost that is part of the unit preselection process, to yield a modified unit preselection process;

preselecting units from the supplemental phoneset and the existing phoneset based on the modified unit preselection process, to yield preselected units; and generating speech based on the preselected units.

16. The computer-readable storage device of claim 15, wherein the supplemental phoneset is a variation of the existing phoneset.

17. The computer-readable storage device of claim 15, wherein the supplemental phoneset comprises a word boundary feature.

* * * * *